US009534575B2

(12) United States Patent
Eberhardt et al.

(10) Patent No.: US 9,534,575 B2
(45) Date of Patent: Jan. 3, 2017

(54) METHOD FOR IGNITING A FUEL/AIR MIXTURE, IGNITION SYSTEM AND GLOW PLUG

(71) Applicant: BorgWarner Ludwigsburg GmbH, Ludwigsburg (DE)

(72) Inventors: Michael Eberhardt, Neckargemünd (DE); Martin Allgaier, Ludwigsburg (DE)

(73) Assignee: BorgWarner Ludwigsburg GmbH, Ludwigsburg (DE)

( * ) Notice: Subject to any disclaimer, the term of this patent is extended or adjusted under 35 U.S.C. 154(b) by 0 days.

(21) Appl. No.: 14/338,961

(22) Filed: Jul. 23, 2014

(65) Prior Publication Data

US 2015/0034055 A1 Feb. 5, 2015

(30) Foreign Application Priority Data

Jul. 31, 2013 (DE) ..... 10 2013 108 223

(51) Int. Cl.

| | |
|---|---|
| ***F02P 19/02*** | (2006.01) |
| ***F02M 31/12*** | (2006.01) |
| ***F23Q 7/00*** | (2006.01) |
| ***F02P 13/00*** | (2006.01) |
| ***F02P 23/04*** | (2006.01) |
| *F02M 31/125* | (2006.01) |

(52) U.S. Cl.

CPC ..... *F02P 19/02* (2013.01); *F02P 13/00* (2013.01); *F02P 23/045* (2013.01); *F23Q 7/001* (2013.01); *F02M 31/125* (2013.01); *F02P 19/028* (2013.01); *F23Q 2007/002* (2013.01)

(58) Field of Classification Search

CPC ..... F02P 19/02; F02P 19/021; F02P 13/00; F02P 23/045; F02P 19/028; F02P 19/026; F02P 2017/125; F23Q 7/001; F23Q 2007/007; F23Q 2007/008; F23Q 2007/002; F02M 31/125; F02M 31/04; F02M 31/12; F02M 31/13; F02M 31/135; F01B 1/12

USPC ..... 123/549, 179.6, 145 R, 145 A, 143 C, 123/169 R, 169 E, 169 P

See application file for complete search history.

(56) References Cited

U.S. PATENT DOCUMENTS

| | | | | | |
|---|---|---|---|---|---|
| 4,487,177 | A | * | 12/1984 | Ishikawa | 123/260 |
| 4,541,898 | A | * | 9/1985 | Mase | H01C 7/041 204/424 |
| 4,541,899 | A | * | 9/1985 | Mase et al. | 205/785 |
| 5,922,229 | A | * | 7/1999 | Kurano | 219/270 |

(Continued)

FOREIGN PATENT DOCUMENTS

| | | |
|---|---|---|
| DE | 100 15 277 B4 | 1/2009 |
| DE | 10 2012 107 411 A1 | 2/2014 |
| WO | WO 2013/169365 A1 | 11/2013 |

*Primary Examiner* — Grant Moubry

(74) *Attorney, Agent, or Firm* — Bose McKinney & Evans LLP

(57) ABSTRACT

What is described is a method for igniting a fuel/air mixture in a combustion chamber of an engine, wherein a pencil, which is electrically insulated with respect to walls of the combustion chamber and contains a heating resistor, is electrically heated to a temperature of at least 800° C. in the combustion chamber of the engine by applying a heating voltage, and a high voltage of at least 500 V, which is different from the heating voltage, is applied to the pencil and thereby ions are generated in the combustion chamber by field emission of electrons. The invention additionally relates to an ignition system and a glow plug.

8 Claims, 3 Drawing Sheets

(56) References Cited

U.S. PATENT DOCUMENTS

| | | | | |
|---|---|---|---|---|
| 6,150,634 | A * | 11/2000 | Haussner et al. | 219/270 |
| 6,285,007 | B1 * | 9/2001 | Chiu et al. | 219/270 |
| 6,321,531 | B1 * | 11/2001 | Caren et al. | 60/275 |
| 6,326,595 | B2 * | 12/2001 | Taniguchi et al. | 219/270 |
| 6,483,079 | B2 * | 11/2002 | Sato et al. | 219/270 |
| 6,555,788 | B1 | 4/2003 | Uhl | |
| 6,994,073 | B2 * | 2/2006 | Tozzi | F02P 9/007 123/143 B |
| 8,153,936 | B2 * | 4/2012 | Kernwein et al. | 219/260 |
| 8,378,273 | B2 * | 2/2013 | Sekiguchi | H05B 3/141 219/270 |
| 8,976,505 | B2 * | 3/2015 | Kernwein et al. | 361/264 |
| 2002/0190050 | A1 * | 12/2002 | Haussner | F23Q 7/001 219/270 |
| 2005/0274707 | A1 * | 12/2005 | Matsubara et al. | 219/270 |
| 2007/0295708 | A1 * | 12/2007 | Yu | F23Q 7/22 219/260 |
| 2008/0302777 | A1 * | 12/2008 | Ando | F02P 19/02 219/270 |
| 2012/0112620 | A1 | 5/2012 | Lykowski et al. | |
| 2013/0293089 | A1 | 11/2013 | Durham | |

* cited by examiner

METHOD FOR IGNITING A FUEL/AIR MIXTURE, IGNITION SYSTEM AND GLOW PLUG

RELATED APPLICATIONS

This application claims priority to DE 10 2013 108 223.8, filed Jul. 31, 2013, which is hereby incorporated herein by reference in its entirety.

BACKGROUND

The invention relates to a method for igniting a fuel/air mixture in a combustion chamber of an engine.

In Diesel engines glow plugs are used to facilitate ignition, especially when the engine is cold. Glow plugs are usually heated to operating temperatures of 1,000° C. or more.

The combustion of fuel creates ions. This causes the conductivity of the gases in the combustion chamber to change significantly. Hence, information about the combustion process can by gained by measuring the electrical conductivity of the content of a combustion chamber. Such measurements are called ion current measurements. Special glow plugs can be used for ion current measurements, e.g., glow plugs disclosed in DE 100 15 277 B4 or U.S. Pat. No. 6,555,788B1.

Glow plugs for ion current measurements have a first terminal for applying a supply voltage for heating, which is provided by pulse-width modulation of an on-board voltage of the vehicle, and a second terminal for applying a measurement voltage of typically 40 V between pulses of the supply voltage. When the measurement voltage is applied to the glow plug, it is disconnected from ground by opening a switch. The measurement voltage then causes an ion current to flow from the glow plug through the gases in the combustion chamber to ground. The strength of the ion current is determined by the ion concentration caused by the combustion process.

SUMMARY

This disclosure teaches how combustion of fuel can be improved.

With a method according to this disclosure, a pencil, e.g., a ceramic pencil, is electrically heated by applying a heating voltage to a temperature of 800° C. or more. A high voltage of at least 500 V is then applied to the heated pencil such that field emission of electrons occurs and the ion concentration is increased in the combustion chamber. The increase in ion concentration improves ignitability and combustion. The high voltage that is applied to the heated glow pencil for causing field emission of electrons may be 1000 V or more, for example.

Due to the heating of the pencil, electrons can escape from the ceramic pencil more easily by field emission. With a glowing pencil, an electric field therefore causes a stronger field emission of electrons than is the case with a cold pencil. When a high voltage is applied to an ignition electrode in the form of a heated ceramic pencil, electrons can accordingly escape more easily by field emission. The field emission can be so strong that a corona discharge is created, but this is not necessary. Even field emission below the threshold that causes a corona discharge can cause a significant improvement of ignitability and combustion. The high voltage can be a DC voltage or an AC voltage, in particular a high-frequency AC voltage. The high voltage is preferably at least 500 V. If the high voltage is an AC voltage, its peak value is at least 500 V, e.g., 1000 V or more. The high voltage may be a pulsed DC voltage of at least 500 V, e.g., of 1000 V or more.

The high-frequency AC voltage can be generated with a high-frequency generator as secondary voltage from a lower primary voltage, for example by means of a transformer. This high-frequency AC voltage can indeed be used to heat the ceramic pencil, but is less suited for this purpose. It is better to heat the ceramic pencil using a separate heating voltage, for example using a DC voltage or pulse width-modulated DC voltage pulses. For example, the on-board supply voltage of the vehicle can be used as a heating voltage. The on-board supply voltage of cars or trucks is usually 12 V or 24 V. The heating voltage can be a pulse-width modulated voltage with an effective value (root mean square value) of less than 10 V. If the primary voltage of the high-frequency generator deviates from the on-board supply voltage, this primary voltage can also be used as heating voltage, for example.

In accordance with an advantageous refinement of this disclosure, the effective value of the high voltage, for example a high-frequency AC voltage, is at least 100 times greater than the effective value of the heating voltage. The heating voltage can be 100 V or less, for example. The high-frequency AC voltage can be 10 kV or more, for example. The high-frequency AC voltage can be between 10 kHz and 5 GHz, for example.

The high-frequency AC voltage and the heating voltage can be applied simultaneously to the ceramic pencil. However, it is also possible to apply the high-frequency voltage only in the pauses between voltage pulses of the heating voltage. With an electric heating of the pencil with pulse width-modulated voltage pulses, the duration of the pulses can be selected depending on the engine speed, such that the pencil is particularly hot when field emission is caused.

The pencil can be heated to temperatures of 1000° C. or more, for example 1200° C. or more. These teachings can be employed primarily for self-igniting internal combustion engines, that is to say diesel engines, but can also be used advantageously in Otto engines.

The pencil of an ignition system according to this disclosure contains a heating resistor. The heating resistor can be formed as a heat-conducting layer at one end of a ceramic pencil. The heat-conducting layer can be electrically contacted by a ceramic inner conductor and a ceramic outer conductor of the pencil. The outer conductor and the inner conductor can be electrically insulated from one another by an insulation layer.

A ceramic pencil that contains a heating resistor can generally be produced in a manner that is not as pointed as conventional ignition electrodes made of metal. With constant voltage, the electric field at an ignition electrode in the form of a ceramic pencil is therefore smaller than with a conventional ignition electrode made of metal. Consequently, a lower field emission and therefore impaired conditions for forming a corona discharge are to be expected. The field emission, however, is facilitated by the increased temperature of the ceramic pencil.

A larger surface compared with conventional ignition electrodes, that is to say a less pointed ignition electrode, has the advantage that the load and therefore also the burn-up are distributed over a larger surface, such that wear is reduced. The larger surface additionally has the advantage that the frequency is reduced, similarly to the top capacity of an antenna. Due to the influence of the larger surface, the resonance of the resonant circuit is broader.

This is associated with an advantage. In order for an AC voltage sufficiently large to form a corona discharge to be applied to the ignition electrode of a conventional corona ignition system as disclosed in WO 2010/011838, the resonant circuit of a corona ignition device has to be excited, specifically with its resonance frequency or a frequency in the vicinity of the resonance frequency. Since the resonance frequency changes constantly depending on the state of the fuel/air mixture and the momentary size of the combustion chamber, the excitation frequency with conventional corona ignition systems has to be tracked continuously with high accuracy, for example with a phase control circuit. This requires a high investment of control electronics. By contrast, a precise tracking of the excitation frequency is less significant with an ignition system according to this disclosure, and therefore electronic control effort can be saved.

The glow plug of an ignition system according to this disclosure in some respects is similar to a conventional glow plug for diesel engines. An important difference, however, lies in the fact that the glow pencil according to this disclosure is electrically insulated with respect to the metal housing in which it is plugged. In the case of known glow plugs, the metal housing is used as a ground contact of the glow pencil. In the case of an ignition system according to this disclosure, this is not possible. The electrical insulation of the pencil with respect to the metal housing of the glow plug can be caused by a ceramic insulation layer that covers the outer conductor of the pencil, or for example by a ceramic sleeve in which the pencil sits. It is important the insulation of the pencil has a dielectric strength of at least 500 V, for example 1000 V or more.

BRIEF DESCRIPTION OF THE DRAWINGS

The above-mentioned aspects of exemplary embodiments will become more apparent and will be better understood by reference to the following description of the embodiments taken in conjunction with the accompanying drawings, wherein.

DETAILED DESCRIPTION

The embodiments described below are not intended to be exhaustive or to limit the invention to the precise forms disclosed in the following detailed description. Rather, the embodiments are chosen and described so that others skilled in the art may appreciate and understand the principles and practices of this disclosure.

Figure 1:
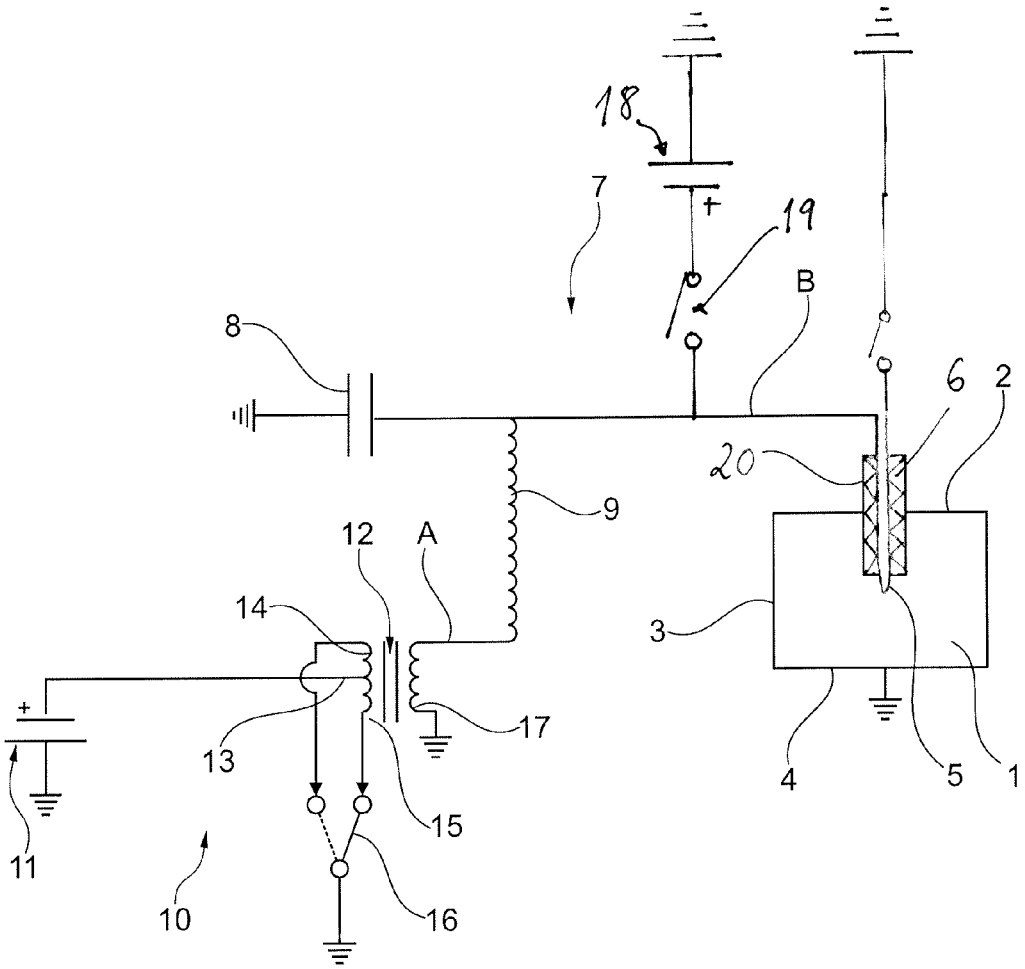
FIG. 1 shows a schematic illustration of an example of a corona ignition system.
Figure 2:
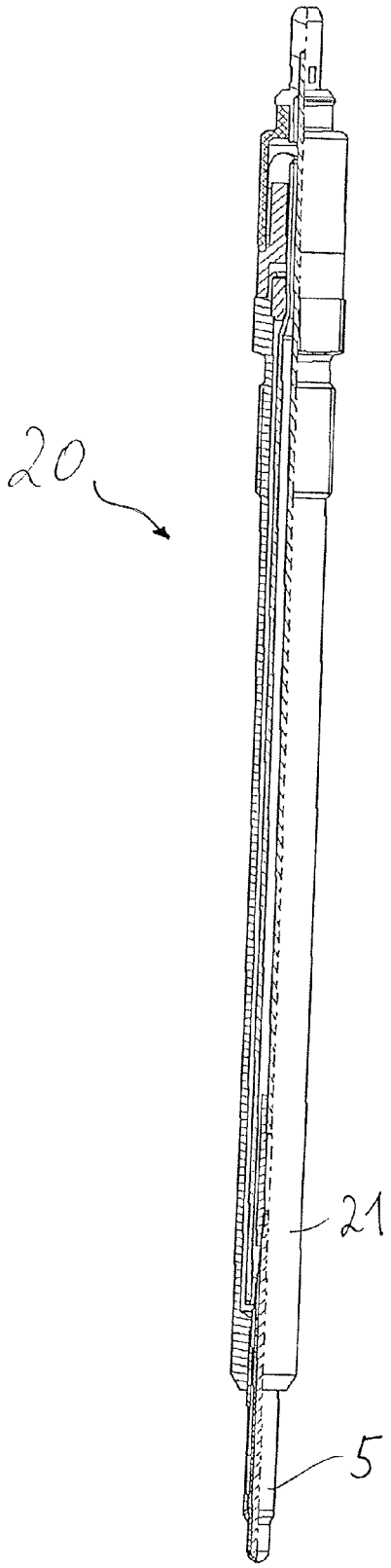
FIG. 2 shows an illustrative embodiment of an igniter for such a corona ignition system.

FIG. 1 shows a combustion chamber 1, which is delimited by walls 2, 3 and 4, which are connected to earth potential. An igniter 20, which is illustrated in FIG. 2, protrudes from above into the combustion chamber 1 and has an ignition electrode 5, which is surrounded at least over part of its length by an insulator 6, by means of which it is guided in an electrically insulated manner through the upper wall 2 into the combustion chamber 1. The ignition electrode 5 and the walls 2 to 4 of the combustion chamber 1 are part of a resonant circuit 7, to which a capacitor 8 and an inductor 9 also belong. The series resonant circuit 7 may comprise further inductors and/or capacitors and other components, which are known to a person skilled in the art as possible parts of series resonant circuits.

To excite the resonant circuit 7, a high-frequency generator 10 is provided, which has a DC voltage source 11 and a transformer 12 with a center tap 13 on its primary side, whereby two primary windings 14 and 15 meet at the center tap 13. The ends of the primary windings 14 and 15 distanced from the center tap 13 are connected alternately to earth by means of a high-frequency switch 16. The switching frequency of the high-frequency switching unit 16 determines the frequency at which the series resonant circuit 7 is excited and can be altered. The secondary winding 17 of the transformer 12 feeds the series resonant circuit 7 at the point A. Thus the high frequency switching unit 16 is part of a controller which sets the high frequency AC voltage.

The series resonant circuit is excited in the vicinity of its resonance frequency, which is generally between 10 kHz and 1 GHz. The AC voltage of the series resonant circuit is applied to the ignition electrode 5 and is generally at least 10 kV, for example 20 kV to 100 kV. The high-frequency AC voltage leads at the ignition electrode 5 to the discharge of electrons by field emission and to the formation of a corona discharge.

A particular feature of the illustrated corona ignition system lies in the fact that a ceramic glow pencil is used as ignition electrode 5 and is electrically heated. In the illustrated illustrative embodiment, a heating voltage is applied to the glow pencil and is supplied by a DC voltage source 18, for example the on-board network of the vehicle. The DC voltage source may be identical to the DC voltage source 11; however, two separate DC voltage sources may also be provided. The heating voltage can be applied as DC voltage or is applied in the form of pulse width-modulated voltage pulses to the glow pencil. A switch 19 that is part of a controller of the ignition system determines when the DC voltage is applied to the pencil 5. The AC voltage can be applied to the glow pencil between the DC voltage pulses. It is also possible, however, to simultaneously apply both the heating voltage and the AC voltage to the glow pencil.

The glow pencil is heated by the heating voltage to a temperature of 800° C. or more, for example 1000° C. or more. The discharge of electrons from the ignition electrode 5 is facilitated, and the field emission is consequently strengthened. The creation of a corona discharge is thus facilitated.

Figure 3:
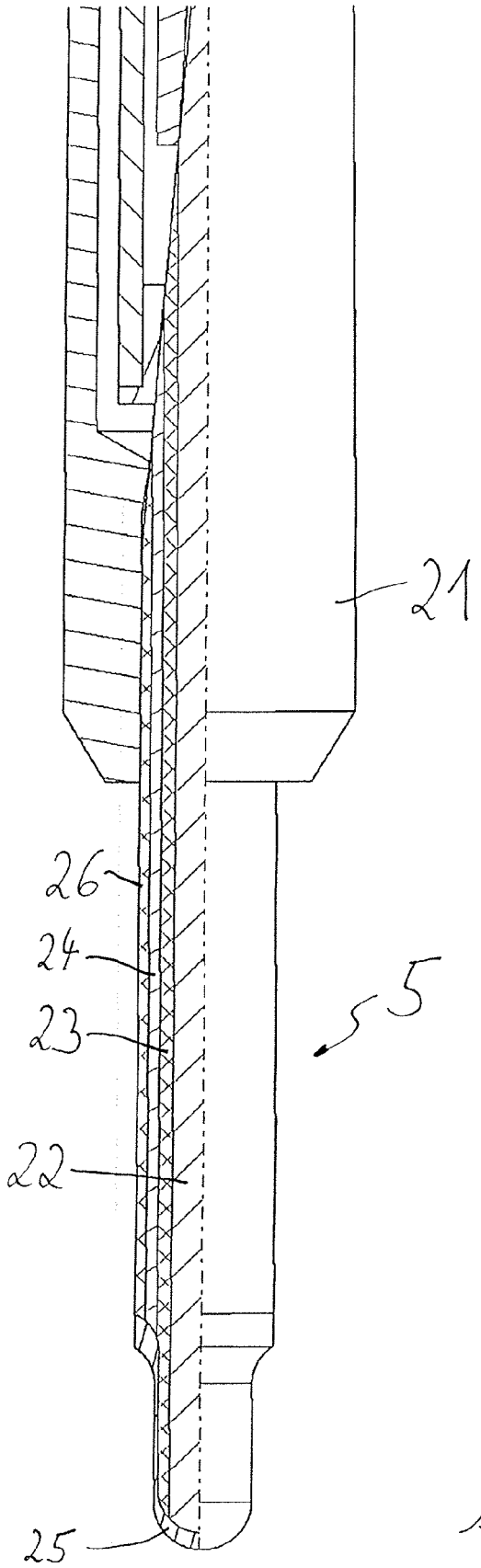
FIG. 3 shows a detailed view of FIG. 2.

An illustrative embodiment of an igniter with an ignition electrode 5 in the form of a ceramic glow pencil is illustrated in FIG. 2. FIG. 3, in a detailed view of FIG. 2, shows the front, combustion-chamber-side part of the igniter with the glow pencil as ignition electrode 5.

The glow pencil plugs into a metal housing 21. As is shown in particular in FIG. 3, the glow pencil consists of a number of ceramic layers. The glow pencil has a core formed from a conductive ceramic. This core is the inner conductor 22 of the glow pencil. The inner conductor 22 is surrounded by a ceramic insulator layer 23. A layer formed from conductive ceramic material is arranged on the insulator layer 23 and will be referred to hereinafter as an outer conductor layer 24. The outer conductor layer 24 and the inner conductor 22 are electrically conductively connected by a heat conductive layer 25 at the end of glow pencil remote from the metal housing 21. The ceramic heat-conducting layer 25 covers an end face of the glow pencil and contacts there the inner conductor 22. The heat-conducting layer 25 may additionally cover the insulator layer 23 in an end portion of the glow pencil. In this case, the outer conductor layer 24 ends at a distance from the end of the glow pencil remote from the metal housing 21 and is electrically contacted there by the heat-conducting layer 25.

It is also possible, however, for the outer conductor layer 24 to extend as far as the end of the glow pencil and for the heat-conducting layer 25 to cover only the end face of the glow pencil.

The heat-conducting layer 25 in the shown illustrative embodiment has a higher electrical resistance than the outer conductor layer 24. The heat-conducting layer 25 and the outer conductor layer 24 are preferably made of different material. A higher electrical resistance of the heat-conducting layer 25 can also be achieved alternatively or additionally by a lower layer thickness.

The outer conductor layer 24 is covered by a further insulator layer 26. The insulator layer 26 causes an electrical insulation of the outer conductor 24 and therefore of the glow pencil from the metal housing 21. This insulation is important so that the glow pencil can serve as an ignition electrode 5 and a corona discharge can form at said glow pencil in the event of application of a high-frequency AC voltage. The heat-conducting layer 25 is uncovered by the insulator layer 26 at least in an end portion.

Instead of the insulator layer 26, a ceramic sleeve for example, from which the glow pencil protrudes, can also be used as ceramic insulation of the glow pencil from the metal housing 21. It is important that the insulator layer of the glow plug from the metal housing 21 has a dielectric strength of at least 500 V, e.g., 1000 V or more.

In the embodiment described above a corona discharge is created by applying a high frequency AC voltage. A significantly improved ignition and better combustion can also be achieved if the applied high voltage is too low to cause a corona discharge and merely causes an increased ion concentration in the combustion chamber by field emission.

Instead of an AC voltage of a resonant circuit a DC voltage or a pulsed DC voltage of 500 V may be applied to the pencil 5.

While exemplary embodiments have been disclosed hereinabove, the present invention is not limited to the disclosed embodiments. Instead, this application is intended to cover any variations, uses, or adaptations of this disclosure using its general principles. Further, this application is intended to cover such departures from the present disclosure as come within known or customary practice in the art to which this invention pertains and which fall within the limits of the appended claims.

| LIST OF REFERENCE NUMERALS | |
|---|---|
| 1. | combustion chamber |
| 2. | wall of the combustion chamber |
| 3. | wall of the combustion chamber |
| 4. | wall of the combustion chamber |
| 5. | ignition electrode |

-continued

| LIST OF REFERENCE NUMERALS | |
|---|---|
| 6. | insulator |
| 7. | resonant circuit |
| 8. | capacitor |
| 9. | inductor |
| 10. | high-frequency generator |
| 11. | DC voltage source |
| 12. | transformer |
| 13. | center tap |
| 14. | primary winding |
| 15. | primary winding |
| 16. | high-frequency switching unit |
| 17. | secondary winding |
| 18. | DC voltage source |
| 19. | switch |
| 20. | igniter |
| 21. | metal housing |
| 22. | inner conductor |
| 23. | outer conductor layer |
| 24. | insulator layer |
| 25. | heat-conducting layer |
| 26. | insulator layer |

What is claimed is:

1. A method for igniting a fuel/air mixture in a combustion chamber of an engine, comprising:

providing a pencil which is electrically insulated with respect to walls of the combustion chamber and contains a heating resistor;

applying a heating voltage to the heating resistor and thereby electrically heating the pencil to a temperature of at least 800° C. in the combustion chamber of the engine; and applying a high voltage of at least 500 V, which is different from the heating voltage, to the heating resistor and thereby generating ions in the combustion chamber by field emission of electrons.

2. The method according to claim 1 wherein the pencil is a ceramic pencil.

3. The method according to claim 1 wherein the high voltage is a high-frequency AC voltage.

4. The method according to claim 3 wherein the high-frequency AC voltage has a frequency of at least 10 kHz.

5. The method according to claim 1 wherein the high voltage is at least one hundred times higher than the heating voltage.

6. The method according to claim 1 wherein the pencil is electrically heated by applying DC voltage pulses of less than 25 V.

7. The method according to claim 6 wherein the high voltage is applied between the DC voltage pulses.

8. The method according to claim 7 wherein the heating voltage has an effective value of less than 10 V.

* * * * *